US006089039A

United States Patent [19]

Yamauchi

[11] Patent Number: 6,089,039

[45] Date of Patent: Jul. 18, 2000

[54] AIR CONDITIONER AND CONDENSER USED THEREFOR

[76] Inventor: Noriyuki Yamauchi, 3-21, Kita-goyo 1-chome, Kita-ku, Kobe-shi, Hyogo, Japan

[21] Appl. No.: 09/244,432

[22] Filed: Feb. 4, 1999

[30] Foreign Application Priority Data

Mar. 12, 1998 [JP] Japan ..... 10-105309
Jul. 24, 1998 [JP] Japan ..... 10-242489

[51] Int. Cl.[7] ..... F25B 1/00

[52] U.S. Cl. ..... 62/498; 62/507; 62/511; 62/DIG. 17; 165/113

[58] Field of Search ..... 62/498, 506, 507, 62/511, 238.6, DIG. 17; 165/112, 113

[56] References Cited

U.S. PATENT DOCUMENTS 4,696,168 9/1987 Woods et al. ..... 62/200
5,435,155 7/1995 Paradis ..... 62/515
5,590,539 1/1997 Marohl et al. ..... 62/84
5,613,368 3/1997 Marohl et al. ..... 62/84
5,689,962 11/1997 Rafalovich ..... 62/90

*Primary Examiner*—Henry Bennett
*Assistant Examiner*—Marc Norman
*Attorney, Agent, or Firm*—McDermott, Will & Emery

[57] ABSTRACT

A second condenser includes a condensation promoting portion that promotes a condensation action on a refrigerant by reduction of the sectional area of a refrigerant path. The condensation promoting portion includes a step-forming wall between the sectional area reduced portion and a refrigerant path portion in the upstream thereof A vortex/turbulent flow generator is provided as necessary in the upstream and downstream of the sectional area reduced portion of the refrigerant path. The air conditioner includes a first condenser and a second condenser that are coupled in a crossflow manner so that an object for heat exchange, that is, a coolant passes first through the second condenser including the condensation promoting portion and then through the first condenser.

19 Claims, 5 Drawing Sheets

AIR CONDITIONER AND CONDENSER USED THEREFOR

BACKGROUND OF THE INVENTION

1. Field of the Invention

The present invention generally relates to an air conditioner condenser and more particularly to an air conditioner condenser that is improved in an environmentally friendly manner. The present invention also relates to an air conditioner using such a condenser.

2. Description of the Background Art

A pipe for carrying out heat exchange in an air conditioner condenser has had a circular or oval sectional shape, with the sectional shape being the same at all portions of the pipe. In order to improve the efficiency of heat exchange, the heat radiation area has been increased by fitting or brazing a fin to the outside of a pipe. Further, improvement in the heat transfer efficiency has been sought by forming various continuous grooves on the inner surface of a pipe to form an uneven portion or a wick on the inner surface. However, the performance improvement has reached a limit in either case.

Recently, refrigerants hazardous to ozone layers such as R12 and 502 have totally been abolished and refrigerants such as R22, CFC and HCFC have been under control. It is requested as environmental measures to replace them with refrigerants having low ozone destruction coefficients such as HFC-134a and 410A and further with refrigerants having low green house effect (warming effect), that is, a refrigerant made of naturally existing substances such as ammonia. For this purpose, various measures have been examined by taking the compatibility between a refrigerant and a compressor lubricant into account, above all, for the enclosed type air conditioner However, when the refrigerants as described above are used without modifying a conventional compressor and the like, their performance can not sufficiently be utilized and the compressor is also applied with an overload and forced to stop.

When an air conditioner condenser is placed between buildings and the condition worsens, that is, the temperature around the condenser extraordinarily rises in summer or the condenser is frosted in winter, a conventional condenser has been unable to operate because of its insufficient ability. Even if a similar condenser is additionally provided, the problems with the insufficient ability, the structure of an outdoor unit used for the condenser housing, and the dimension have been caused.

SUMMARY OF THE INVENTION

Accordingly, an object of the present invention is to provide an air conditioner in which a conventional compressor and other parts can be used as they are even when a conventional problematic refrigerant is replaced by a refrigerant having a low ozone destruction coefficient and lower green house effect.

Another object of the present invention is to provide an air conditioner that is improved to be able to suppress increase in the necessary motive power of a compressor, that is, the power consumption of a motor for driving the compressor or the fuel consumption of a heat engine for driving the compressor without substantially modifying a conventional air conditioner.

Still another object of the present invention is to provide an air conditioner that is improved to be able to operate even when the temperature environment around a condenser becomes severe.

Still another object of the present invention is to provide an air conditioner that is improved to be able to sufficiently condense a high temperature and high pressure refrigerant from a compressor.

Still another object of the present invention is to provide a condenser that is used for such an air conditioner.

An air conditioner condenser according to a first aspect of the present invention includes a condensation promoting portion for promoting a condensation action on a refrigerant by reduction of the sectional area of a refrigerant path.

Preferably, the condensation promoting portion includes a step-forming wall between the sectional area reduced portion and a refrigerant path portion in the upstream thereof.

Preferably, the condensation promoting portion includes a main path and a plurality of branch paths branched off from the main path in the downstream of the wall.

Preferably, the total sectional area of the plurality of branch paths is made equal to or less than the sectional area of the main path.

Preferably, the wall connects the sectional area reduced portion and the refrigerant path in the upstream thereof continuously and smoothly.

Preferably, the condensation promoting portion includes a protrusion provided on the inner wall surface of the refrigerant path near the wall for disturbing the flow of a refrigerant.

Preferably, the protrusion includes an upstream protrusion situated in the upstream of the wall and a downstream protrusion situated in the downstream of the wall.

A condenser used for an air conditioner according to a second aspect of the present invention includes an upstream refrigerant path and a downstream refrigerant path. In the downstream of the upstream refrigerant path, an upstream sectional area reduced path is provided which has a sectional area smaller than the upstream refrigerant path. In the upstream of the downstream refrigerant path, a downstream sectional area reduced path is provided which has a sectional area smaller than the downstream refrigerant path. A plurality of branch paths are provided between the upstream sectional area reduced path and the downstream sectional area reduced path.

Preferably, the total sectional area of the plurality of branch paths is equal to or less than the sectional area of the upstream sectional area reduced path or the downstream sectional area reduced path.

An air conditioner according to a third aspect of the present invention is intended to carry out a refrigeration action by circulating a refrigerant while changing its state in order of evaporated→compressed →condensed→pressure-reduced→evaporated states. The air conditioner includes a first condenser and a second condenser situated in the downstream of the first condenser for carrying out a final condensation action. The second condenser includes a condensation promoting portion for promoting a condensation action on a refrigerant by reduction of the sectional area of a refrigerant path, and has an upstream refrigerant path and a downstream refrigerant path. In the downstream of the upstream refrigerant path, an upstream sectional area reduced path is provided which has a sectional area smaller than the upstream refrigerant path. In the upstream of the downstream refrigerant path, a downstream sectional area reduced path is provided which has a sectional area smaller than the downstream refrigerant path. A plurality of branch paths are provided between the upstream sectional area reduced path and the downstream sectional area reduced path.

According to the condenser of the present invention, when the air conditioner is used for cooling, the sectional area is reduced in the refrigerant path for carrying out heat radiation of the condenser, where a refrigerant is wet and exists in the state of saturated steam. Therefore, a large amount of turbulent flows are caused and a gaseous phase is separated before and behind the sectional area reduced portion. At the same time, part of refrigerant energy as a fluid reflects in the upstream direction, causing pressure build-up, and applies a compression effect on a refrigerant in the gaseous phase in the upstream. As a result, condensation of the refrigerant is promoted. In the downward direction, the bundle of flows is compressed and the condensation action of the refrigerant is promoted. Thus, the heat transfer coefficient from a refrigerant in a liquid phase, which does not contain a gaseous phase, to a pipe is improved.

When a main path and a plurality of branch paths which are branched off from the main path are included in the downstream of the wall, the heat radiating capability is further improved and the heat radiation effect is increased.

When a protrusion for disturbing the flow of a refrigerant is formed on the inner wall surface of the refrigerant path situated in the vicinity of the wall, a vortex flow or a turbulent flow of the refrigerant is generated and separation of a gaseous phase and a liquid phase in the refrigerant is further promoted.

In an air conditioner according to a fourth aspect of the present invention, the effects as described below are found when the first and second condensers are coupled in a crossflow manner so that an object for heat exchange passes first through the second condenser and then through the first condenser.

In short, in heating operation, the flow of a refrigerant is opposite from it is in cooling operation. In this case, the first condenser, which is an outdoor unit, functions as an evaporator (herein referred to as a first condenser for convenience, although it becomes an evaporator in the case of heating operation), an indoor unit functions as a condenser, and the second condenser which is provided as an outdoor unit functions as a condenser. Even when the condensation action of the indoor unit is insufficient, condensation of a refrigerant completes in a portion where the sectional area of the second condenser is reduced. Further, heat that is taken away from the refrigerant in the second condenser is discharged toward the first condenser which is an outdoor unit (in fact, an evaporator since it is in heating operation), and the outdoor unit is prevented from being frosted.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The embodiments of the present invention will be described in the following with respect to the drawings.

First Embodiment

A case where an air conditioner is operated as a cooler should be described first.

Figure 1:
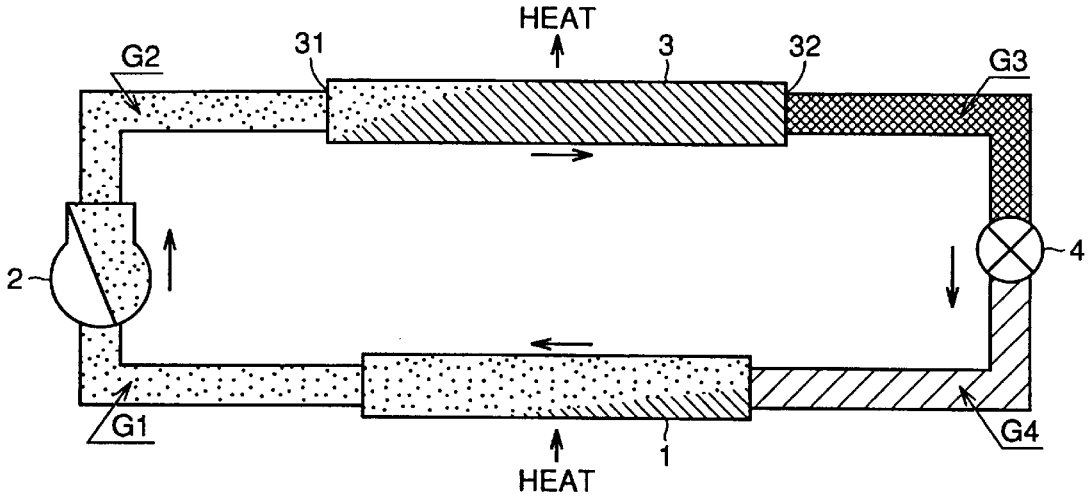
FIG. 1 shows an air conditioner basic cycle during cooling.

Referring to FIG. 1, air conditioner basic cycle during cooling is as described below. In an evaporator 1, wet steam G4 at low temperature and low pressure absorbs heat from the outside. Then, it exits from evaporator 1 and changes to superheated steam G1 at low temperature and low pressure. The refrigerant goes through a compressor 2 and changes to gas G2 at high temperature and high pressure. Gas G2 at high temperature and high pressure discharges calorie which is the sum of the thermal equivalent of the refrigeration level of evaporator 1 and the compression work from condenser 3 to the outside, and the gas changes to liquid G3 at normal temperature and high pressure. Thereafter, refrigerant G3 is changed to wet steam G4 at low temperature and low pressure by an expansion valve 4. The circulation is performed for cooling operation.

Then, change in the refrigerant state from an inlet 31 to an outlet 32 of condenser 3 should be described.

Figure 2:
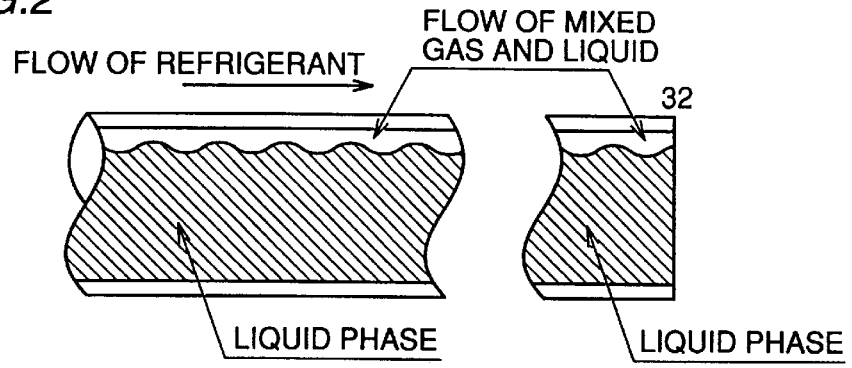
FIG. 2 shows the state of a refrigerant in the pipe of a condenser.
Figure 3:
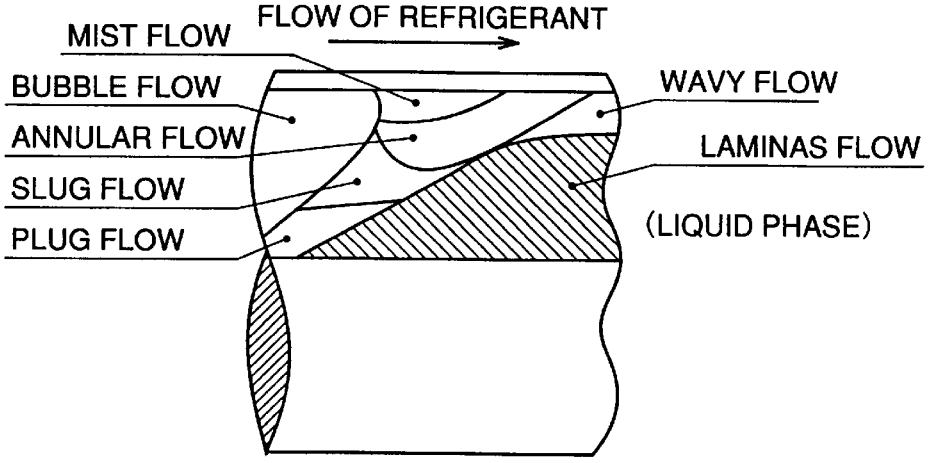
FIG. 3 shows a flow of mixed gaseous and liquid phases being observed from a micro perspective.

The refrigerant that enters condenser 3 from compressor 2 is in the state of gas G2 at high temperature and high pressure. It is cooled from the outside of the pipe by an external coolant such as air or water, condensed, and changed to a liquid phase. However, when the calorie that is the sum of the thermal equivalent of the refrigeration level of evaporator 1 and the compression work in compressor 2 is not discharged outside, there is a flow of mixed gaseous and liquid phases in the vicinity of the inner wall surface of the condenser pipe as shown in FIG. 2. FIG. 3 is a conceptual diagram of the state being observed from a micro perspective.

Referring to FIG. 3, a refrigerant has a process in which it changes from the gas state (gaseous phase) via a bubble flow, a mist flow, a plug flow, a slug flow, an annular flow and a wavy flow to the liquid phase of a laminas flow. Normally, a liquid phase flows from the bottom to the center when the pipe is horizontal, and a gaseous phase flows to the periphery in the pipe, pushed by the liquid phase.

In condenser 3, a refrigerant externally discharges calorie by the action of a coolant. When a new refrigerant replaces at this time, problems are caused if the ability of compressor 2 can not cope with the performance of the refrigerant. When the temperature of the refrigerant is high and the ability of the condenser is insufficient, problems are also caused. The problems are as described below.

Before and behind outlet 32 of condenser 3, a refrigerant assumes the state in which the rate of remained gas is high. When the refrigerant passes through expansion valve 4 and reaches evaporator 4 in this state, the cooling capability is lowered. Further, the compressor is applied with an overload and stopped, and the function of the air conditioner is lost.

A method of actively condensing a refrigerant containing a gaseous phase will be described below.

Figure 4A:
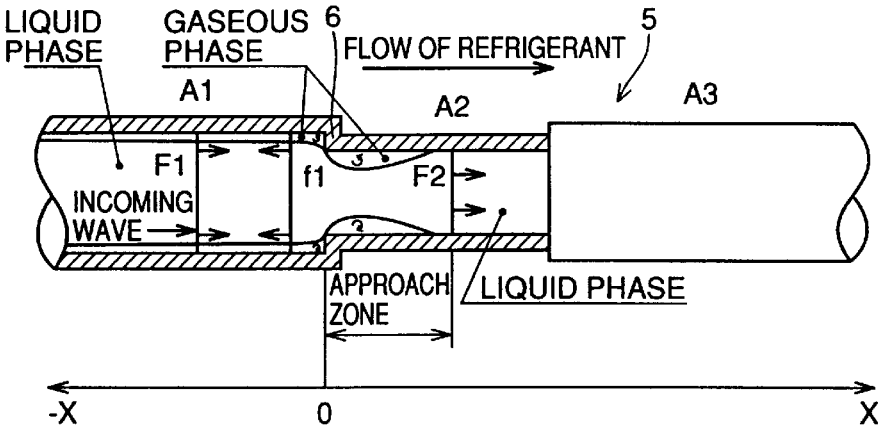
FIGS. 4A and 4B are sectional diagrams of a condensation promoting portion according to a first embodiment.
Figure 4B:
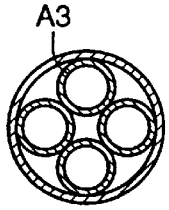

FIGS. 4A and 4B are sectional diagrams of an air conditioner condenser according to an embodiment of the present invention. The condenser includes a condensation promoting portion 5 that promotes a condensation action on a refrigerant by reduction of the sectional area of a refrigerant path. Condensation promoting portion 5 is designed by taking a coolant and the type of a refrigerant into account. In short, condensation promoting portion 5 includes a step-forming wall 6 between a sectional area reduced portion A2 and a refrigerant path portion A1 situated in the upstream. In the state of wet saturated steam, a refrigerant collides with wall 6. Thus, gas remaining in the refrigerant is condensed, and condensation of the refrigerant is promoted.

Referring to FIGS. 4A and 4B, it is assumed that the position of the sectional area change is 0 in the direction of refrigerant flow. An incoming wave F1 of a refrigerant from the direction of -X collides with wall 6, and part of it becomes f1 and reflects. The energy of the reflected wave causes pressure build-up in the direction of -X and compresses the refrigerant. A remaining part of the refrigerant becomes f2 and proceeds in the direction of X. In the process where the bundle of flows is compressed, gas remaining in the refrigerant is condensed. Thus, condensation of the refrigerant is promoted.

The pressure change and the refrigerant condensation efficiency, described above, are varied according to a coolant, the type of a refrigerant, and the specific volume of the refrigerant.

The phenomenon above can be explained by the Bernoulli's theorem as changes in the pressure, speed and potential energy of a fluid before and behind a portion where the sectional area of a pipe changes.

Abrupt change of a refrigerant from the state of mixed gas and liquid to the state of liquid is a transitional phenomenon that the specific gravity of a refrigerant before and behind a sectional area reduced portion substantially changes in an irregular manner. Therefore, the pressure and speed of a refrigerant abruptly change. However, the operating state of a refrigeration cycle is carried out fairly smoothly except before and behind the sectional area changed portion.

A method of improving the heat exchange capability between a coolant and a compressed, liquid phase refrigerant at high temperature and high pressure should be described in the following.

Table 1 shows the values of the inner diameter, surface area and sectional area of the pipe in the condensation promoting portion shown in FIGS. 4A and 4B and the flow speed of a refrigerant.

TABLE 1

(arbitrary unit)

| | Pipe | | | |
|---|---|---|---|---|
| | A1 | A2 | A3 | A3 × 4 |
| Inner diameter | 1 | 0.707 | 0.353 | — |
| Surface area | 3.14 | 2.22 | 1.11 | 4.44 |
| Sectional area | 0.785 | 0.392 | 0.098 | 0.392 |
| Flow speed of refrigerant | 1 | ≅2 | — | ≅2 |

Referring to FIGS. 4A and 4B and Table 1, pipe A2 has a sectional area ½ times that of pipe A1. The surface area of pipe A2 is 2.22 compared with 3.14 of pipe A1. The refrigerant flow speed of pipe A2 is about 2 times the speed of pipe A1. Since the heat radiating capability of a pipe is proportional to the product of its surface area and its flow speed, the heat radiating capability of pipe A2 is 1.41 (2.22÷3.14×2) times that of pipe A1.

Further, in order to improve the heat radiating capability, four pipes A3 each having the same sectional area are provided behind 0 point on the X axis, that is, behind the approach zone. A condensation promoting portion is provided so that the total sectional area of pipes A3 is equal to the sectional area of pipe A2. When the inner diameter of pipe A1 is 1, the total surface area of four pipes A3 is 4.44 while the surface area of pipe A1 is 3.14. The magnification (A3/A1) is 1.414 (4.44÷3.14), and the flow speed of a refrigerant in pipes A3 is about 2 times that in pipe A1. Since the heat radiation amount is proportional to the product of a surface area and a flow speed, the heat radiating capability of four pipes A3 is 2.828 (4.44÷3.14×2) times that of pipe A1.

Assuming that the average heat transfer coefficient when a refrigerant completely becomes a liquid phase is $K_1$ and the average heat transfer coefficient in the case of mixed gas and liquid is $K_2$, then the ratio $K_1/K_2$ becomes much larger that 1, and the ratio may be a two digit value according to the type and specific volume of a refrigerant. Accordingly, the heat radiating capability increases with the ratio.

In the embodiment, the pipes have been described based on a case where the sectional shape is circular. However, similar effects can be attained by any sectional shapes, such as rectangular and oval shapes, as far as the sectional shape and the material are suitable to heat exchange. A trumpet or conical sectional shape may be better according to the type of a refrigerant and the position in a pipe where a refrigerant in a gaseous phase remains.

In order to improve the ability of the condenser, the above described condensation promoting portion is preferably provided at a plurality of suitable portions in the condenser pipe.

Since promotion of the condensation and heat radiation actions causes abrupt change of a refrigerant from a gaseous phase to a liquid phase, and the volume and pressure of the refrigerant are reduced, the necessary motive power of the compressor decreases.

Although the embodiment has been described based on a case where the air conditioner is used for cooling, the air conditioner can also be used for heating by modifying the pipe path.

By forming the above described condensation promoting portion in evaporator 1, the performance of the evaporator can be improved when the evaporator is used as a condenser (for heating operation).

A vortex/turbulent flow generator provided in a pipe before and behind a portion where the sectional area changes should be described in the following.

Figure 5A:
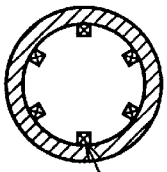
FIGS. 5A to 5C show a position to which a vortex/turbulent flow generator is attached.
Figure 5B:
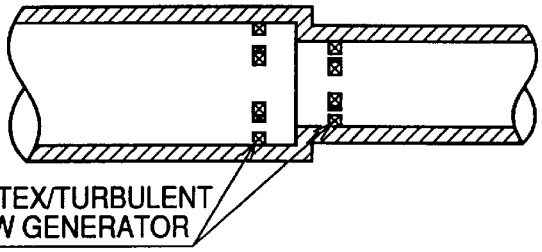
Figure 5C:
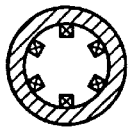

FIGS. 5A to 5C are a conceptual diagram showing the position of a vortex/turbulent flow generator when it is attached in a pipe.

Figure 6:
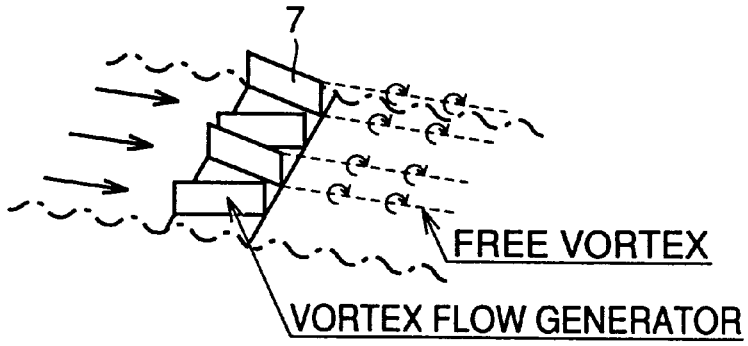
FIG. 6 is a conceptual diagram of the vortex flow generator.

FIG. 6 is a conceptual diagram when a vortex flow generator is provided on the inner wall of a pipe. Referring to FIGS. 5A to 6, a protrusion 7 for generating a vortex flow is provided on the inner wall of the pipe.

Figure 7A:
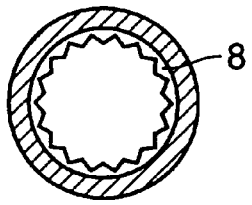
FIGS. 7A to 7C show specific examples of the turbulent flow generator.
Figure 7B:
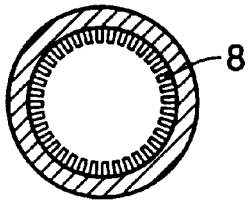
Figure 7C:
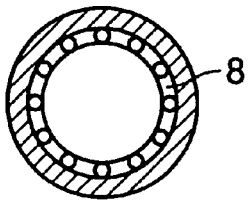

FIGS. 7A to 7C are conceptual diagrams when a turbulent flow generator for generating a turbulent flow is provided on the inner wall surface of a pipe. A protrusion 8 for generating a turbulent flow is provided on the inner wall surface of the pipe. FIG. 7A shows an example of a serrated protrusion. FIG. 7B shows a comb-shaped protrusion. FIG. 7C shows a protrusion provided with a through hole. Referring to FIGS. 5A to 5C, such protrusions are provided before and behind a portion where the sectional area changes.

Whether these vortex/turbulent flow generators are attached, how to set their shapes and dimensions, whether they are formed before, behind a sectional area reduced portion, or both, and the like are determined, for example, by taking the type of a refrigerant, the specific volume of a refrigerant in the sectional area reduced portion into account.

Second Embodiment

An air conditioner having the above described condensation promoting portion will be described in the following.

First, a case where a conventional conditioner is driven and refrigerant R22 that contains chlorine is replaced by refrigerant HFC-134a that does not contain chlorine should be described.

An existing air conditioner was operated after refrigerant R22 was removed from the air conditioner and refrigerant HFC-134a was applied instead. It was confirmed by a level gauge that refrigerant HFC-134a almost remained to be a gaseous phase at the outlet of the condenser and hardly condensed even after approximately one hour. Further, the compressor temperature rose extraordinarily, and a compressor bearing was burnt and broken. The present invention was made to prevent it.

The condensation promoting portion according to the present invention was additionally provided in the existing air conditioner. R22 was used as a refrigerant. The heat exchange capability was 12000 kCAL/h. A three-phase motor having the performance of 220 V, 60 Hz and output 3.7 kW was used as a motor for driving the compressor.

Cooling and heating operations will be described in this order. The present invention will be described by comparing the performance of a conventional conditioner using R22 as a refrigerant and a conditioner according to the present invention using HFC-134a as a refrigerant.

Figure 8:
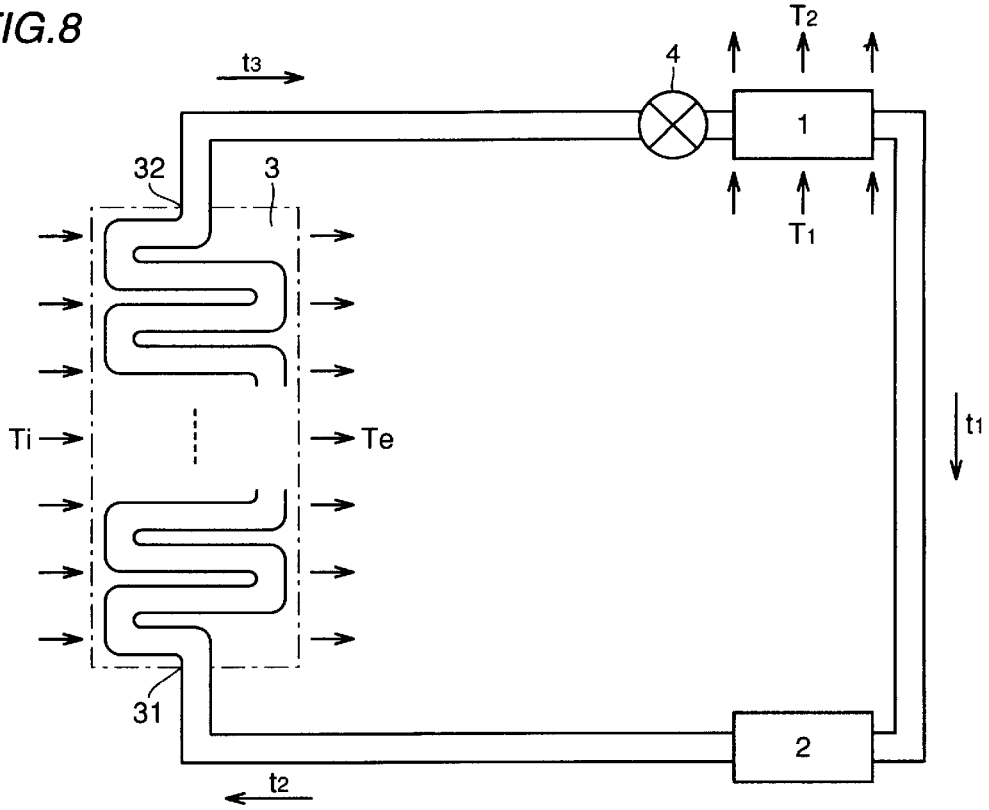
FIG. 8 is a conceptual diagram of a conventional air conditioner during cooling.

FIG. 8 is a conceptual diagram of a conventional air conditioner during cooling, using refrigerant R22. The refrigerant was the atmospheric air. When the atmospheric air temperature was 33° C., the measured temperature of each portion was as described below. When Ti was 33° C., Te, $t_1$, $t_2$, $t_3$, $T_1$ and $T_2$ were 38° C., 3° C., 80° C., 48° C., 27° C. and 17° C., respectively, the pressure of the compressor outlet was 20 kg/cm$^2$, and the used power was 4.1 kW. When the ambient temperature rose and temperature Ti of the atmospheric air was 38° C., Te, $t_1$, $t_2$, $t_3$, $T_1$ and $T_2$ were 42° C., 0° C., 88° C., 55° C., 30° C. and 25° C., respectively, the pressure of the compressor outlet was 24 kg/cm$^2$, and the used power was 4.8 kW.

From the results above, the following was made clear in the conventional conditioner. When condenser 3 is provided in a high temperature environment, the ability of the condenser declines, making the cooling capability in rooms insufficient, and the gas pressure of a refrigerant rises, causing a protection device to operate and the compressor to stop, and so on. Accordingly, the compressor may fail and its life may be shortened.

Figure 9:
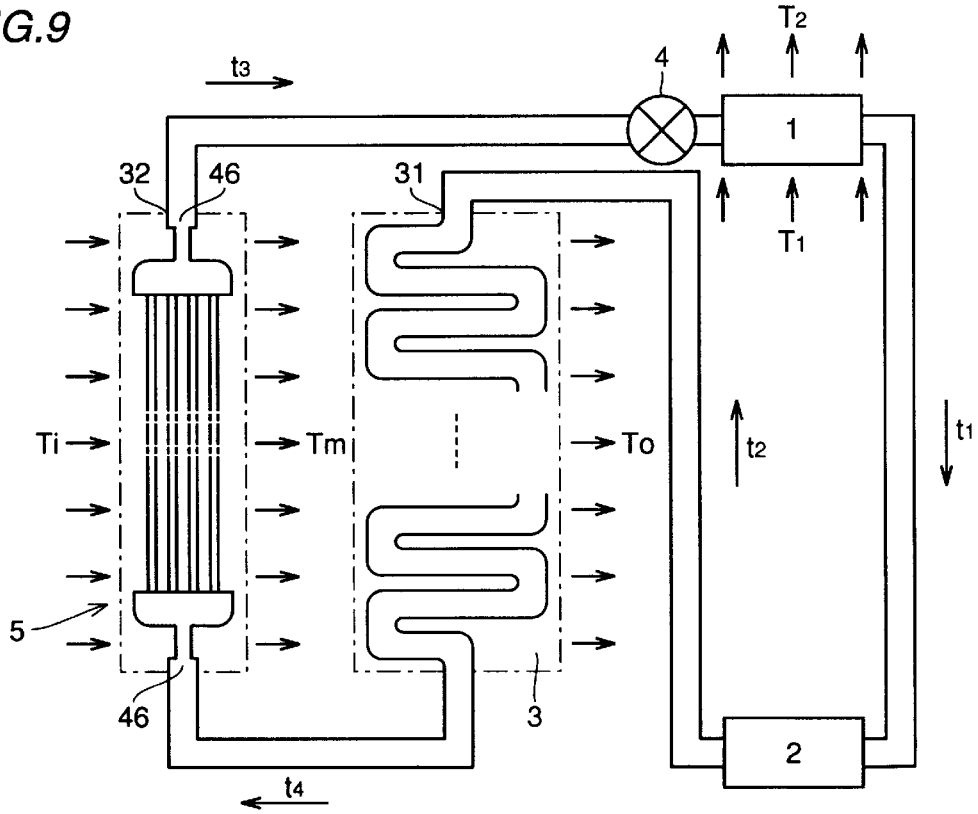
FIG. 9 is a conceptual diagram of an air conditioner according to a second embodiment during cooling.

In comparison, in an air conditioner according to the present invention, existing condenser 3 (hereinafter referred to as a first stage condenser) was additionally provided with a condensation promoting portion 5 (hereinafter referred to as a second stage condenser) as shown in FIG. 9. First stage condenser 3 and second stage condenser 5 were coupled in a crossflow manner (where the proceeding direction of a refrigerant from a macro perspective is orthogonal to the proceeding direction of a coolant). Refrigerant R22 of first stage condenser 3 was replaced by HFC-134a. The heat exchange capability of second stage condenser 5 was 5000 kCAL/h.

In the conditioner shown in FIG. 9, when Ti was 38° C., Tm, To, $t_1$, $t_2$, $t_4$, $t_3$, $T_1$ and $T_2$ were 41° C., 45° C., 7° C., 70° C., 55° C., 41° C., 27° C. and 13° C., respectively, the pressure of the compressor outlet was 12 kg/cm$^2$, and the used power was 3.6 kW.

It was confirmed from the results that refrigerant HFC-134a was safely condensed by additionally providing the second stage condenser and coupling it to the existing condenser in a crossflow manner. The power consumption was reduced 25% from that of the conditioner shown in FIG. 8 (in the case which Ti was 38° C.). The operating pressure of the compressor was also low, and there was no danger of stopping the condenser due to gas leakage and gas pressure build-up.

Due to change in the sectional area near the inlet of second stage condenser 5, a refrigerant is subjected to adiabatic compression by a reflected wave. The refrigerant increases in calorie by a condensation action due to the compressed flow. Further, since air passes which is at 41° C. higher than the inlet temperature (38° C.) of first stage condenser 3, the heat radiation effect is lowed as compared with the existing condenser. Since the condensation action in the sectional area reduced portion 46 of the inlet of second stage condenser 5 and the heat discharging in second stage condenser 5 are sufficiently carried out, however, the above described effect reduction is compensated.

Sectional area reduced portion 46 is also provided at the outlet of second stage condenser 5 to promote condensation during heating as described below. During cooling, a liquid phase refrigerant expands because it spreads in sectional area reduced portion 46. Although it gives a negative effect to cooling, it was confirmed that the liquid phase refrigerant is overcooled when the distance between second stage condenser 5 and expansion valve 4 is a conventional distance and therefore the above described expansion rarely affects the cooling effect.

When the air conditioner is intended for cooling, sectional area reduced portion 46 of the outlet does not have to be provided.

Similar effects can be attained even when a capillary is provided in stead of expansion valve 4 in the existing air conditioner.

Third Embodiment

Figure 10:
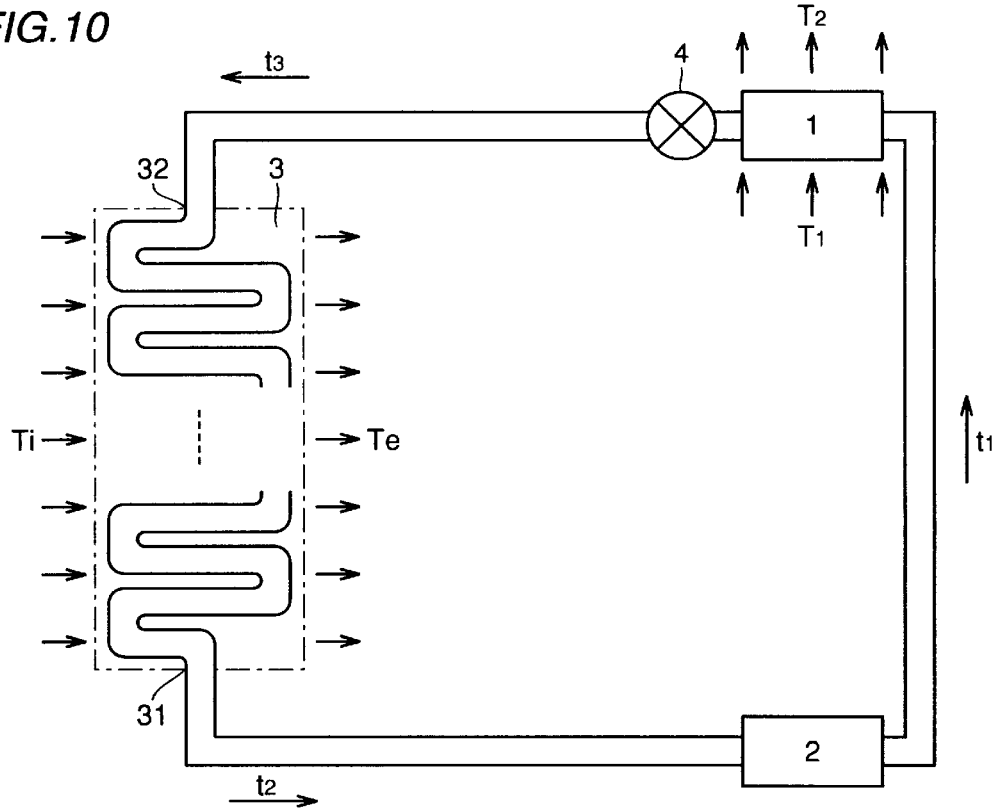
FIG. 10 is a conceptual diagram of a conventional air conditioner during heating.

FIG. 10 is a conceptual diagram of an existing air conditioner during heating. The coolant was the atmospheric air. When temperature Ti of the atmospheric air as a coolant was 50° C., Te, $t_1$, $t_2$, $t_3$, $T_1$ and $T_2$ were 0° C., 55° C., 5° C., 40° C., 17° C. and 30° C., respectively, the pressure of the compressor outlet was 16 kg/cm$^2$, and the used power was 4.0 kW.

In the case of heating, existing condenser 3 functions as an evaporator for absorbing heat from external air, and evaporator 1 functions as a condenser for radiating heat.

When the temperature of external air falls, the amount of heat absorption of condenser 3 provided in a low temperature environment decreases and therefore the heating capability is lowered. Further, condenser 3 is frosted, and thus the function of absorbing heat from external air weakens.

Figure 11:
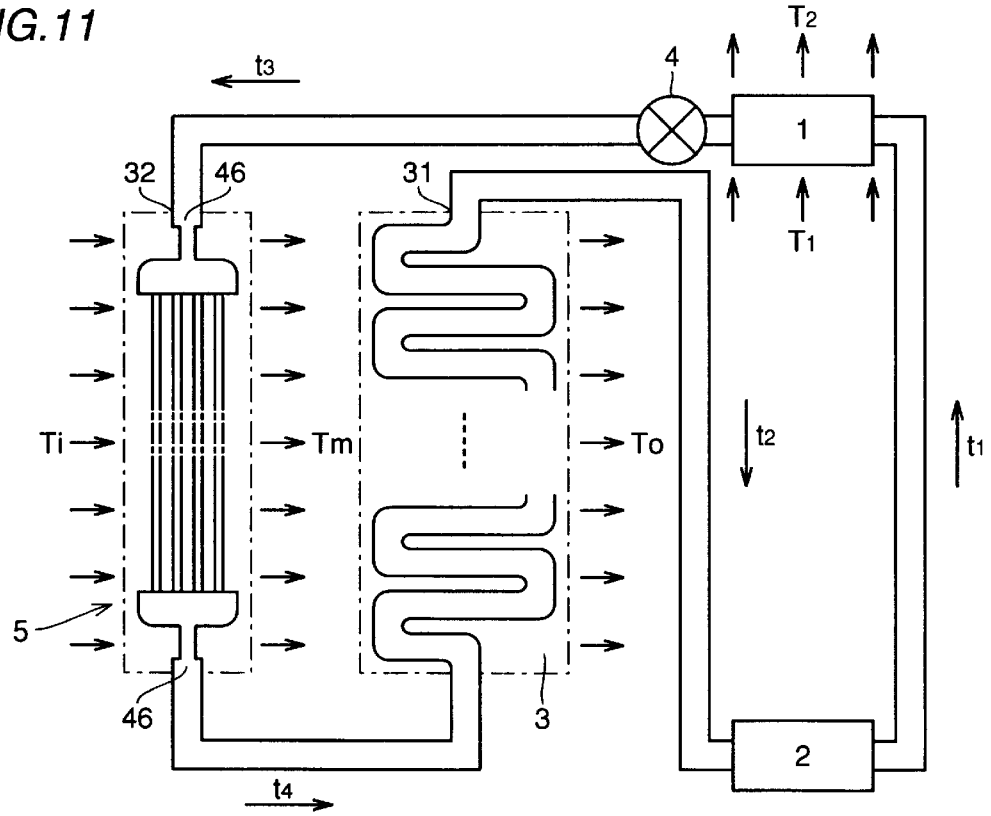
FIG. 11 is a conceptual diagram of an air conditioner according to a third embodiment during heating.

In FIG. 11, the same air conditioner was used, a condensation promoting portion (second stage condenser) according to the present invention was added to the existing condenser (first stage condenser), and they were coupled in a crossflow manner.

In the conditioner shown in FIG. 11, when Ti was 5° C., Tm, To, $t_1$, $t_2$, $t_4$, $t_3$, $T_1$ and $T_2$ were 10° C., 5° C., 60° C., 3° C., 7° C., 42° C., 17° C. and 35° C., respectively, the pressure of the compressor outlet was 10 kg/cm$^2$, and the used power was 3.1 kW.

The crossflow coupling of the first and second stage condensers is characterized in that first stage condenser 3 functions as an evaporator during heating and second stage condenser 5 functions as a condenser even during heating. In other words, when the condensation action of evaporator 1 is insufficient, the condensation action on a refrigerant mixed with a gaseous phase is carried out in sectional area reduced portion 46 of the inlet of second stage condenser 5. Further, heat taken out of the refrigerant in second stage condenser 5 is radiated and applied to first stage condenser 3. Thus, first stage condenser 3 is prevented from being frosted. Then, the refrigerant is expanded in sectional area reduced portion 46 of the outlet of second stage condenser 5, sent to first stage condenser 3 where it is evaporated, and sent to compressor 2.

As described above, by additionally providing the second stage condenser that is adapted to the performance, structure and dimension of the existing air conditioner condenser on the outside of the condenser and the side of atmospheric absorption, the air conditioner can cope with a severe temperature environment. When the temperature environment becomes severer, deterioration of the cooling and heating functions can be prevented by additionally providing a condensation promoting portion in a similar manner.

By coupling the first and second condensers in a crossflow manner, a coolant only has to be made a liquid phase to some extent in the first stage condenser according to the refrigerant type. Since the both condensers share the function, therefore, the entire condensers can be designed in an optimum manner and manufactured easily. Accordingly, an air conditioner that includes a second stage condenser from the beginning can be provided.

As described above, according to the present invention, even when a chlorine type refrigerant having a high ozone destruction coefficient such as R22, CFC and HCFC is replaced by a refrigerant having a low ozone destruction coefficient such as HCF-134a and 410A, or further by a hydrocarbon type coolant having small warming effect or a naturally existing refrigerant such as ammonia, the compressor and other equipment can be used as they are, the necessary motive power (the power consumption of a motor for driving the compressor or the fuel consumption of a heat engine) of the compressor can be prevented from increasing, and an environmentally friendly air conditioner can be provided.

Even when the condenser is placed in a severe temperature environment, the condenser can be operated to endure it.

By improving an existing air conditioner through combination of the present invention with an existing condenser, similar operation can be possible to a conventional method while preserving the environment.

Since the options of optimum design and manufacturing method of an air conditioner condenser are increased, the present invention contributes to development of air conditioners.

Although the present invention has been described and illustrated in detail, it is dearly understood that the same is by way of illustration and example only and is not to be taken by way of limitation, the spirit and scope of the present invention being limited only by the terms of the appended claims.

What is claimed is:

1. An air conditioner condenser used for an air conditioner, comprising a condensation promoting portion for promoting a condensation action on a refrigerant by reduction of a sectional area of a refrigerant path.

2. The air conditioner condenser according to claim 1, wherein said condensation promoting portion includes a step-forming wall between said sectional area reduced portion and a refrigerant path portion in the upstream thereof.

3. The air conditioner condenser according to claim 2, wherein said condensation promoting portion includes a main path and a plurality of branch paths branched off from the main path in the downstream of said wall.

4. The air conditioner condenser according to claim 3, wherein a total sectional area of said plurality of branch paths is made equal to or less than a sectional area of said main path.

5. The air conditioner condenser according to claim 2, wherein said wall connects said sectional area reduced portion and said refrigerant path portion in the upstream thereof continuously and smoothly.

6. The air conditioner condenser according to claim 2, wherein said condensation promoting portion includes a protrusion provided on an inner wall surface of the refrigerant path near said wall for disturbing a refrigerant flow.

7. The air conditioner condenser according to claim 6, wherein said protrusion includes an upstream protrusion in the upstream of said wall and a downstream protrusion in the downstream of said wall.

8. A condenser used for an air conditioner, comprising:

an upstream refrigerant path;

a downstream refrigerant path;

an upstream sectional area reduced path situated in the downstream of said upstream refrigerant path and having a sectional area smaller than the upstream refrigerant path;

a downstream sectional area reduced path situated in the upstream of said downstream refrigerant path and having a sectional area smaller than the downstream refrigerant path; and a plurality of branch paths branched off and situated between said upstream sectional area reduced path and said downstream sectional area reduced path.

9. The condenser used for an air conditioner according to claim 8, wherein a total sectional area of said plurality of branch paths is equal to or less than the sectional area of said upstream sectional area reduced path or said downstream sectional area reduced path.

10. An air conditioner for carrying out a refrigeration action by circulating a refrigerant while changing its state in order of evaporated→compressed→condensed→pressure-reduced→evaporated states, comprising;

a first condenser;

a second condenser situated in the downstream of said first condenser for carrying out a final condensation action; and said second condenser including a condensation promoting portion for promoting a condensation action on a refrigerant by reduction of a sectional area of a refrigerant path.

11. The air conditioner according to claim 10, wherein said condensation promoting portion includes a step-forming wall between said sectional area reduced portion and a refrigerant path portion in the upstream thereof.

12. The air conditioner according to claim 11, wherein said condensation promoting portion includes a main path and a plurality of branch paths branched off from the main path in the downstream of said wall.

13. The air conditioner according to claim 12, wherein a total sectional area of said plurality of branch paths is made equal to or less than a sectional area of said main path.

14. The air conditioner according to claim 11, wherein said wall connects said sectional area reduced portion and said refrigerant path portion in the upstream thereof continuously and smoothly.

15. The air conditioner according to claim 11, wherein said condensation promoting portion includes a protrusion provided on an inner wall surface of the refrigerant path near said wall for disturbing a refrigerant flow.

16. The air conditioner according to claim 15, wherein said protrusion includes an upstream protrusion in the upstream of said wall and a downstream protrusion in the downstream of said wall.

17. An air conditioner for carrying out a refrigeration action by circulating a refrigerant while changing its state in order of evaporated→compressed→condensed→pressure-reduced→evaporated states, comprising:

a first condenser;

a second condenser situated in the downstream of said first condenser for carrying out a final condensation action; and said second condenser including an upstream refrigerant path, a downstream refrigerant path, an upstream sectional area reduced path situated in the downstream of said upstream refrigerant path and having a sectional area smaller than the upstream refrigerant path, a downstream sectional area reduced path situated in the upstream of said downstream refrigerant path and having a sectional area smaller than the downstream refrigerant path, and a plurality of branch paths branched off and situated between said upstream sectional area reduced path and said downstream sectional area reduced path.

18. The air conditioner according to claim 17, wherein a total sectional area of said plurality of branch paths is equal to or less than the sectional area of the upstream sectional area reduced path or said downstream sectional area reduced path.

19. The air conditioner according to claim 17, wherein said first condenser and said second condenser are coupled in a crossflow manner so that an object for heat exchange passes first through said second condenser and then said first condenser.

* * * * *

UNITED STATES PATENT AND TRADEMARK OFFICE

CERTIFICATE OF CORRECTION

PATENT NO. : 6,089,039

DATED : July 18, 2000

INVENTOR(S) : Noriyuki YAMAUCHI

It is certified that error appears in the above-identified patent and that said Letter Patent is hereby corrected as shown below:

On the Title page:

In the Abstract

Line 6, after "thereof" insert --.--.

In the Specification:

Column 1, Line 32, after "conditioner" insert --.--.

Column 8, Line 54, replace "50°C" with --5°C--.

Column 10, Line 2, replace "dearly" with --clearly--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*